US006232721B1

(12) United States Patent
Danielsons

(10) Patent No.: US 6,232,721 B1
(45) Date of Patent: May 15, 2001

(54) INDUCTIVE OUTPUT TUBE (IOT) AMPLIFIER SYSTEM

(75) Inventor: David Christopher Danielsons, Maineville, OH (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/596,676

(22) Filed: Jun. 19, 2000

(51) Int. Cl.[7] ..... H01J 23/18
(52) U.S. Cl. ..... 315/5.37; 330/44
(58) Field of Search ..... 315/5.37, 3, 5.38, 315/404; 313/447, 448; 330/44, 45

(56) References Cited

U.S. PATENT DOCUMENTS

| | | | | |
|---|---|---|---|---|
| 4,480,210 | | 10/1984 | Preist et al. | 315/4 |
| 4,527,091 | * | 7/1985 | Preist | 317/5.37 |
| 5,650,751 | * | 7/1997 | Symons | 313/447 |
| 5,691,667 | | 11/1997 | Pickering et al. | 330/44 |
| 5,736,820 | | 4/1998 | Bardell | 315/505 |
| 6,084,353 | * | 7/2000 | Bohlen | 315/5.37 |
| 6,133,786 | * | 10/2000 | Symons | 330/44 |

* cited by examiner

*Primary Examiner*—Don Wong
*Assistant Examiner*—Thuy Vinh Tran
(74) *Attorney, Agent, or Firm*—Tarolli, Sundheim, Covell, Tummino & Szabo L.L.P.

(57) ABSTRACT

An inductive output tube (IOT) amplifier system is presented for receiving an RF input signal and providing therefrom an amplified RF output signal. The system includes a high tension DC voltage supply and an IOT tube. The IOT tube includes a cathode coupled to the voltage supply for emitting electrons, an anode coupled to the supply for accelerating the electrons, a collector located downstream from the anode that collects the electrons, and a grid located between the cathode and the anode for controlling electron emission from the cathode. The tube has an input for receiving a modulated RF input signal between the grid and the cathode. An output resonant cavity is interposed between the anode and the collector. An output is coupled to the cavity for providing amplified RF output signal. The tube exhibits an inherent interelectrode capacitance which may cause distortions in the output signal. An inductor is interposed between the high tension supply and the cathode such that the inductor and the inherent capacitance form a low pass filter that reduces any distortions in the output signal.

15 Claims, 3 Drawing Sheets

INDUCTIVE OUTPUT TUBE (IOT) AMPLIFIER SYSTEM

BACKGROUND OF THE INVENTION

1. Technical Field

The present invention is directed to the art of RF broadcast transmission systems and, more particularly, to improving the linearity of an inductive output tube (IOT).

2. Description of the Prior Art

It is known that an inductive output tube (IOT) has particular application for use in television broadcasting wherein high kilowatt level RF power is required. Examples of an IOT include the U.S. Patents to Preist, et al. U.S. Pat. No. 4,480,210, Symons U.S. Pat. No. 5,650,751, Pickering, et al. U.S. Pat. No. 5,691,667 and Bardell U.S. Pat. No. 5,736,820 the disclosures of which are herein incorporated by reference.

Inductive Output Tubes or IOT, as they are commonly called, are high vacuum electron tubes, which allow an electron beam to travel from one end to another in a controlled way. There are four primary parts to an IOT: a cathode which emits electrons, an anode which accelerates the electrons, a collector which collects the electrons, and a grid for controlling the electron emission. The electrons are emitted from a spherical surface cathode consisting of a tungsten matrix heated from behind by a tungsten heater. A spherical pyrolytic carbon grid is positioned close to the cathode and controls the emissions of electrons from the cathode. The cathode is maintained at a relatively high potential (−35,000 volts for typical tubes) while the grid is at a relatively low potential (−50 to −250 volts for typical tubes) with respect to the cathode. If the grid is made less negative with respect to the cathode, then more electrons are emitted. The high electric field between the cathode and anode makes the emitted electrons travel toward the anode or collector. A magnetic field is used to focus the electrons into a beam. Emitted electrons are collected in the collector completing the circuit.

For use as an amplifying device, a radio frequency cavity is positioned such that it can induce a voltage between the grid and cathode, thus modulating the electron emission from the cathode. The electrons emitted from the cathode are accelerated as they travel toward the anode. If a second radio frequency cavity is placed between the cathode and anode in such a way that the electron beam passes through the cavity, then the electrons passing through the cavity will induce an RF voltage in the cavity. This RF voltage can then be coupled from the cavity. It should be noted that the tuned cavity and electron beam form the complete resonant circuit. Changes in the electron beam can shift the resonant frequency of the cavities.

The Inductive Output Tube is used primarily as a high power UHF amplifier. One primary use is in UHF television transmitters operating in the frequency range of 470 MHz to 860 MHz. It is used both for analog television and digital television transmissions. In order to obtain good efficiency, the IOT is operated in a class A/B mode of operation. Due to the class A/B mode of operation, the amplifier draws current which is proportional to the modulation frequencies of the RF signal applied. For analog and digital television signals, these modulation frequencies cover the range of DC through 8 MHz and are commonly called video currents.

In the construction of an IOT, the pyrolytic grid is extremely fragile. Due to the high acceleration voltages used, it is possible for the tube to arc from grid to anode. If an arc occurs, the high tension supply may destroy the grid. To overcome this problem, a crowbar or other current limiting device is placed between the IOT and the high tension supply. If an arc occurs, the crowbar directs the high tension supply current away from the IOT preventing the delicate grid from being damaged. Common crowbars use either a gas filled thyratron or a triggered spark gap. These crowbars use a controlled arc to divert the current from the high tension supply away from the IOT. Since the undesired arc in the IOT and the controlled arc in the crowbar have the same impedance, a series resistor must be placed between the crowbar and the IOT, thus forcing the high tension current through the crowbar and away from the IOT.

Since the IOT draws video currents from the high tension supply, the series resistance causes a voltage drop. This voltage drop has the undesirable effect of modulating the cathode voltage. This modulation of the cathode voltage causes an undesirable effect of re-modulation. Re-modulation is due to the fact that a change in the cathode voltage produces a corresponding change in the amplifier's gain and phase characteristic. These gain and phase changes are the cause of AM to AM and AM to PM distortions and are also referred to as non memory-full distortions (non-linear distortions). Also, any changes to the cathode voltage causes a corresponding change in the current density of the electron beam. As the electron beam passes through the cavities, the density changes have the effect of changing the frequency response or tuning of the cavities. This dynamic change in frequency response also causes the undesirable distortion called memory-full distortion (linear distortion).

To further compound the problem, the high tension supply is typically located between several to 100 feet from the amplifier. The inductance of the interconnect wire at these lengths to video currents also introduces a voltage drop to the cathode voltage at the tube which further compounds the effects of re-modulation.

The emission of electrons from the cathode is greatly enhanced when the cathode is operated at elevated temperatures. In practice, this is accomplished by heating the cathode with a filament. A typical IOT filament draws between 10 and 30 amperes of current. To prevent the filament from emitting electrons, it is embedded within the cathode to shield it from the high tension acceleration voltage. To prevent the filament from acting as an anode, one end is connected to the cathode. Thus, the cathode lead to the tube must not only supply the video current due to the modulated radio frequency signal applied but it must supply the filament current simultaneously.

In the construction of an IOT, ceramic materials are used to support the cathode, grid, anode and collector structures. These ceramic materials create small capacitors which exists between the cathode and anode (typically 1000 pF) and grid to anode (typically 100 pF).

The radio frequency input cavity connects between the cathode and the grid. This cavity must also provide isolation from the high tension supply. The insulating materials used in its construction also generate capacitors from cathode to anode and grid to anode.

When the cathode is heated by a filament, electrons in the cathode are emitted but cannot travel to the collector due to the control grid blocking their path. A cloud of electrons forms between the cathode and grid. This cloud of electrons forms a capacitor.

Since the cathode has mass and is heated, there is stored energy in the cathode. This stored energy frees electrons for emission but they cannot be emitted since the area between the cathode and control grid is already filled with electrons. These freed electrons in the cathode also create a capacitance.

This invention makes use of these capacitors to create an effective video bypass for the high tension supply. By placing an inductor in series with the cathode, an effective low pass filter is created from the above capacitors and the added inductor. This filter is highly effective for the video frequencies. This filter has the effect of reducing the cathode ripple due to the series resistance and long wire inductance to the high tension supply. Video currents are supplied from these capacitors and the high tension supply must now only provide only the average current. Voltage drop at the cathode is reduced and the undesired re-modulation effects are also reduced.

A further improvement can be obtained by the addition of capacitor placed across the grid supply. This capacitor effectively couples the grid to anode capacitance to the cathode providing further reduction to the high tension supply ripple.

SUMMARY OF THE INVENTION

The present invention contemplates the provision of an IOT amplifier system that receives an RF input signal and provides therefrom an amplified RF output signal. The system includes a high tension DC voltage supply. An IOT tube is provided that includes a cathode coupled to the voltage supply for emitting electrons, an anode coupled to the supply for accelerating the electrons, a collector located downstream from the anode that collects the electrons, and a grid located between the cathode and the anode for controlling electron emission from the cathode. The tube has an input for receiving a modulated RF input signal and applying same between the grid and the cathode. An output resonant cavity is interposed between the anode and the collector. An output is coupled to the cavity for providing therefrom the amplified RF output signal. The tube exhibits an inherent interelectrode capacitance that may cause distortions in the output signal. An inductor is interposed between the high tension supply and the cathode such that the inductor and the inherent capacitance form a low pass filter that reduces any distortions in the output signal.

BRIEF DESCRIPTION OF THE DRAWINGS

The foregoing and other advantages of the invention will become more apparent to one skilled in the art to which the present invention relates upon consideration of the following description of the invention with reference to the accompanying drawings, wherein.

DESCRIPTION OF THE PREFERRED EMBODIMENTS

Figure 1:
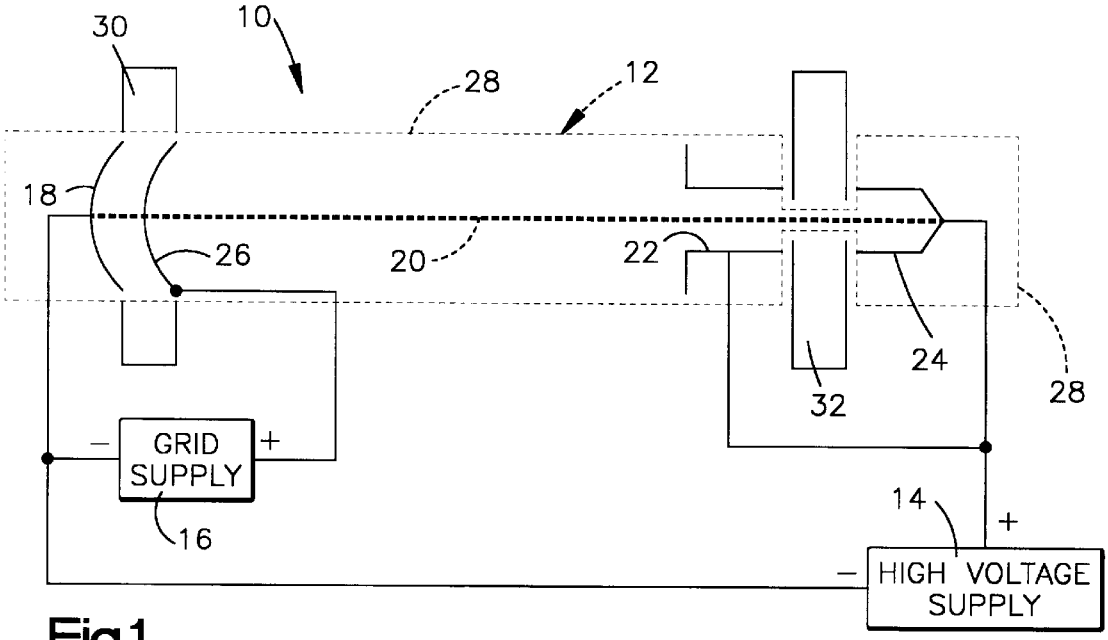
Fig.1 PRIOR ART
FIG. 1 is a schematic-block diagram illustration of prior art useful in explaining the background to the present invention.
Figure 2:
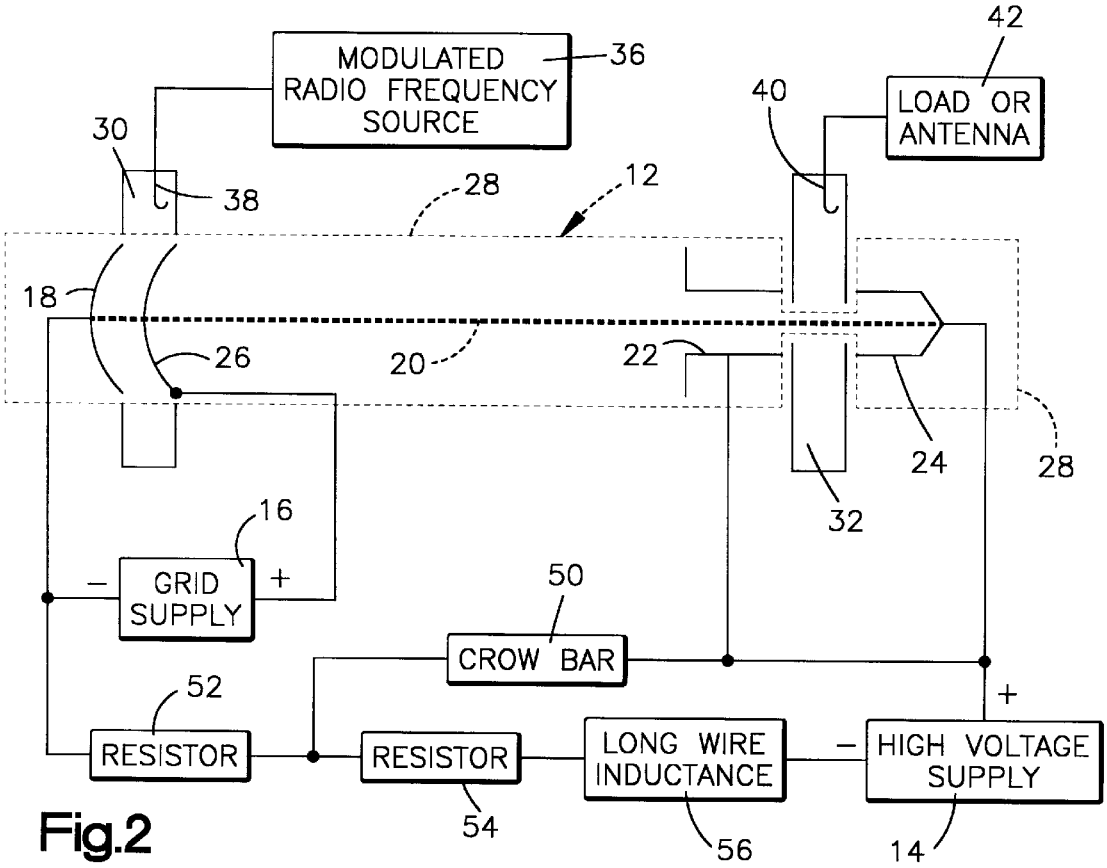
Fig.2 PRIOR ART
FIG. 2 is a schematic-block diagram illustration of a prior art IOT amplifier system.

Before describing the preferred embodiments of the present invention, attention is first directed to the prior art depictions in FIGS. 1 and 2. As illustrated in FIG. 1, an inductive output tube IOT amplifier system 10 includes an IOT 12, a high tension DC voltage supply 14 and a grid supply 16. The tube 12 includes a cathode 18 coupled to the negative side of the high voltage supply 14. This supply may be on the order of −35 kV. The cathode 18 emits electrons along an electron beam 20 and these electrons are accelerated by an anode 22 coupled to the positive side of the supply 14 for accelerating the electrons. A collector 24 is located downstream from the anode 22 and collects the electrons. A grid 26 is located between the cathode and the anode and serves to control the electron emission from the cathode. The grid is at a relatively low potential (on the order of −50 to −250 volts) with respect to the cathode. If the grid is made less negative with respect to the cathode, then more electrons are emitted. The elements of the tube thus described are located within a sealed glass tube 28 (illustrated by dotted lines in FIGS. 1 and 2). The cathode 18 and the grid 26 are each spherical in shape and constructed of metal. The anode 22 is somewhat tubular and coaxially surrounds the axis of the beam 20. The anode is constructed of metal. The collector 24 is located downstream from the anode 22.

In addition to the foregoing, the IOT includes an input resonant cavity 30 and an output resonant cavity 32. The input cavity 30 is of metallic construction and coaxially surrounds the tube 28 and is coupled between the cathode and anode. Similarly, the output cavity 32 is of metallic construction and coaxially surrounds the tube 28 and is interposed between the anode 22 and the collector 24.

As is conventional, an RF input signal is supplied to the input of the IOT 12, as by a modulated radio frequency source 36 and a probe 38, such as an inductive loop that extends within the cavity 30. Alternatively, a capacitive probe may be provided. The amplified output RF signal is provided in a known manner in the output cavity 32 with the amplified output RF signal being extracted as with an inductive loop 40 extending to a load 42 which may take the form of an antenna for broadcasting purposes.

The IOT 12 employs a pyrolytic grid 26 which is extremely fragile. Due to the high acceleration voltages employed, it is possible for the tube to arc from the grid 26 to the anode 22. If an arc occurs, the high tension supply 14 may destroy the grid. To overcome this problem, a crowbar circuit 50 or other current limiting device is placed between the IOT and the high tension supply. If an arc occurs, the crowbar circuit directs the high tension supply current away from the IOT, preventing the delicate grid 26 from being damaged. Common crowbar circuits employ either a gas filled thyratron or a triggered spark gap. These crowbar circuits use a controlled arc to divert the current from the high tension supply away from the IOT. Since the undesired arc in the IOT and the controlled arc in the crowbar have the same impedance, a series resistor 52 is placed between the crowbar circuit and the IOT, thus forcing the high tension current through the crowbar and away from the IOT.

Since the IOT 12 draws video current from the high tension supply 14, the series resistance represented by resistor 52 and the inherent resistance of the connection to the tube presented by resistor 54, a voltage drop takes place. This voltage drop has the undesirable effect of modulating the cathode voltage. This modulation of the cathode voltage causes an undesirable effect of re-modulation. The resulting gain and phase changes are the cause of AM to AM and AM to PM distortions and these distortions are also referred to as non-memory-full distortions (non-linear distortions). Any changes to the cathode voltage causes corresponding changes to the current density of the electron beam. As the electron beam passes through the resonant cavities 30 and 40, the density changes have the effective change in the frequency response or tuning of the cavities. This dynamic change in frequency response causes undesirable distortions which may be referred to as memory-full distortions (linear distortions). Also, the high tension supply 14 is typically located between several to 100 feet from the IOT 12. The inductance 56 of the interconnect wires at these lengths to the video current also introduces a voltage drop to the cathode voltage at the tube which further compounds the effects of re-modulation.

Figure 3:
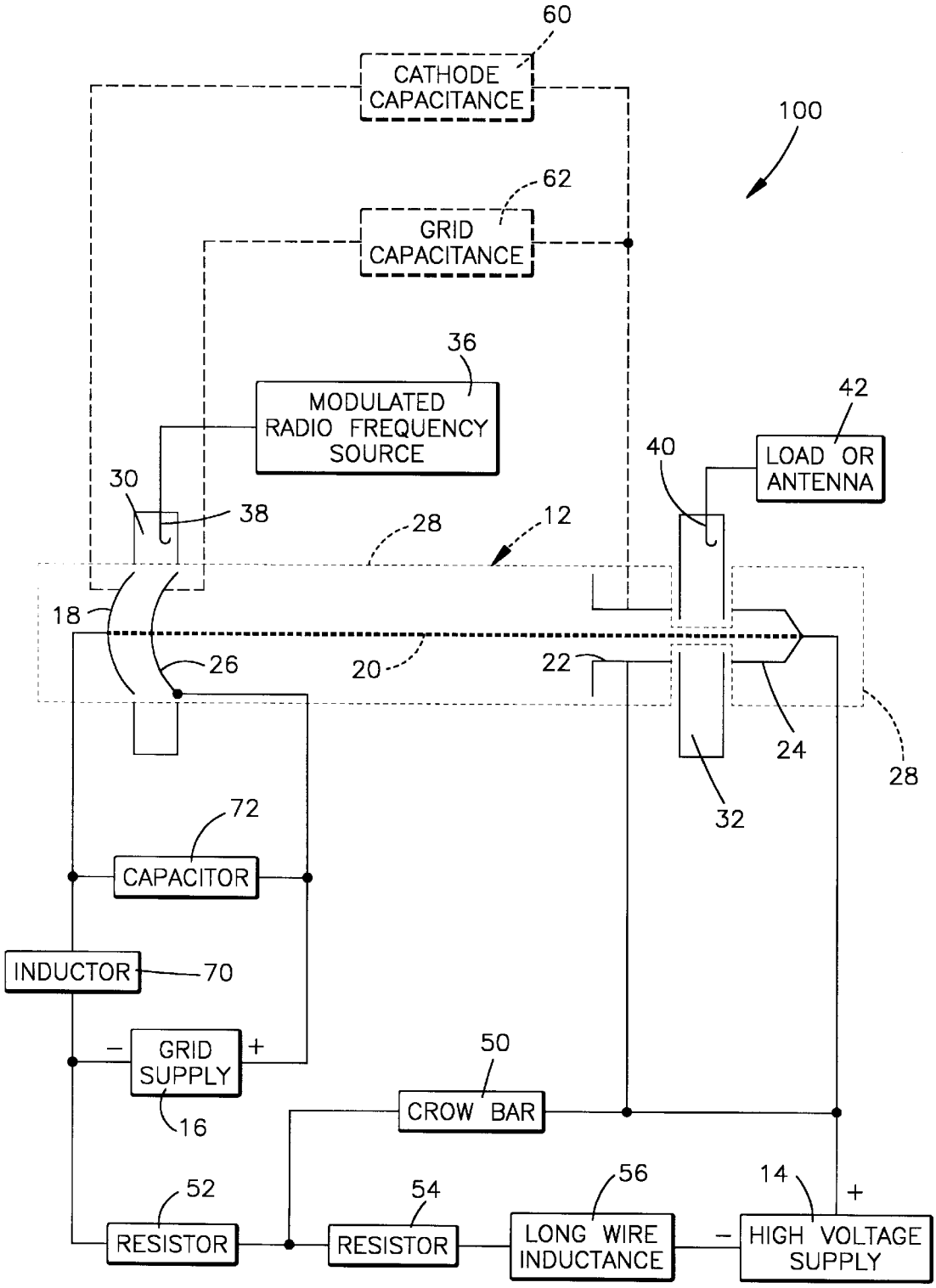
FIG. 3 is a schematic-block diagram illustration of one embodiment of an IOT amplifier system in accordance with the present invention; and, FIG. 4 is a schematic-block diagram illustration of a second embodiment of the invention herein.

Reference is now made to FIG. 3 which illustrates an improved inductive output tube amplifier system 100 constructed in accordance with the present invention. This embodiment is similar in many respects to the prior art depiction in FIGS. 1 and 2, and, consequently, like components are identified with like character references.

In the construction of the IOT 12, ceramic materials are used to support the cathode 18, grid 26, anode 22 and the collector 24. These ceramic materials (not shown in the drawings herein) create small capacitors which exist between the cathode and anode (typically about 1,000 pF) and grid to anode (typically 100 pF).

The input resident cavity 30 connects between the cathode 18 and the grid 26. The cavity must provide isolation from the high tension supply. The insulating materials used in its construction generate capacitance from the cathode to the anode and from the grid to the anode. The capacitance from the cathode to the anode may be referred to as the cathode capacitance 60 and the capacitance from the grid to the anode may be referred to as the grid capacitance 62. The capacitance 60 between the metal surfaces of the cathode and the anode is created by the inherent construction of the tube as well as the input cavity cathode capacitance. Additionally, the grid capacitance 62 includes the grid capacitance of the tube created by the inherent construction of the tube and the input cavity grid capacitance.

The emission of electrons from the cathode is greatly enhanced when the cathode is operated at elevated temperatures by heating the cathode with a filament closely associated with the cathode. However, when the cathode is heated by the filament, electrons in the cathode are emitted but cannot travel to the collector due to the control grid blocking the path. A cloud of electrons forms between the cathode and the grid. This cloud of electrons forms additional capacitance between the cathode and grid adding to the total cathode capacitance 60 (FIG. 3,).

In accordance with the present invention, an inductor 70 is connected in the series circuit with the cathode 18. This inductor in conjunction with the capacitance 60 and 62 defines an effective low pass filter. This filter is highly effective for the video frequencies employed. The filter has the effect of reducing the cathode ripple due to the series resistance and long wire inductance to the high tension supply 14. Video currents are supplied from these capacitances and the high tension supply must now only provide only an average current. The voltage drop at the cathode is reduced and the undesired re-modulation effects are also reduced. In view thereof, both the linear and the non-linear distortions are reduced.

The addition of the inductor 70 forms the basis for filtering, allowing the cathode current to be drawn from the aggregate sum of the capacitance created by the tube cathode capacitance, the tube grid capacitance, the input cavity cathode capacitance and the input cavity grid capacitance.

In addition, a capacitor 72 is added and this is placed across the grid supply 16. This effectively couples the tube grid capacitance and the input cavity grid capacitance to the cathode providing further reduction of the high tension supply ripple voltage.

Figure 4:
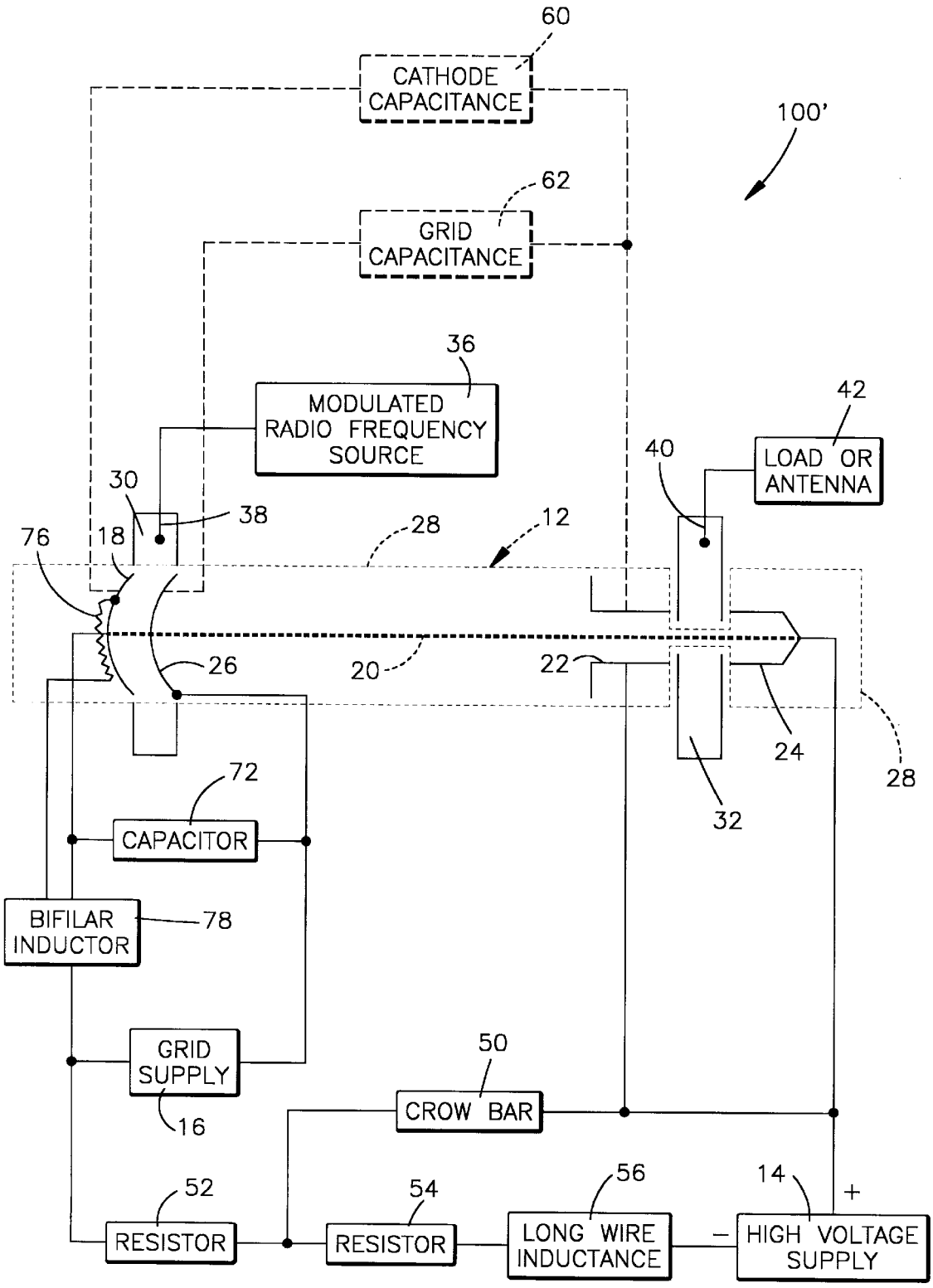

Reference is now made to FIG. 4 which illustrates another embodiment of the amplifier system 100'. This embodiment is similar to that as illustrated in FIG. 3 and accordingly like components are identified with like character references with only the differences are described below.

As stated previously, the emission of electrons from the cathode is greatly enhanced when the cathode is operated at elevated temperatures. This is accomplished by heating the cathode with a filament such as filament 76, see FIG. 4. This filament draws between 10 and 30 amperes of current. To prevent the filament from emitting electrons, it is embedded within the cathode to shield it from the high tension acceleration voltage. To prevent the filament from acting as an anode, one end (see FIG. 4) is connected to the cathode. Thus, the cathode lead to the tube must not only supply the video current due to the modulation radio frequency signal applied, but it must supply the filament current simultaneously. In order to reduce the size of an inductor designed to carry 10 to 30 amperes of current and to prevent the added inductor from saturation due to filament current, the inductor takes the form of a bifilar inductor 78. Both the cathode and filament current are routed through the bifilar inductor. The magnetic fields in the inductor due to the high filament current cancel, preventing the inductor from saturating.

Although the invention has been described in conjunction with preferred embodiments, it is to be appreciated that various modifications may be made without departing from the spirit and scope of the invention that is defined by the appended claims.

What is claimed is:

1. An inductive output tube (IOT) amplifier system for receiving an RF input signal and providing therefrom an amplified RF output signal, comprising:

a high tension DC voltage supply;

an IOT tube including a cathode coupled to said voltage supply for emitting electrons, an anode coupled to said supply for accelerating said electrons, a collector located downstream from said anode that collects said electrons, and a grid located between said cathode and said anode for controlling electron emission from said cathode;

said tube having an input for receiving a modulated RF input signal and applying same between said grid and said cathode;

an output resonant cavity interposed between said anode and said collector;

an output coupled to said cavity for providing therefrom said amplified RF output signal;

said tube exhibiting an inherent interelectrode capacitance which may cause distortions in said output signal;

an inductor interposed between said high tension supply and said cathode such that said inductor and said inherent capacitance form a low pass filter that reduces any distortions in said output signal.

2. An amplifier system as set forth in claim 1 including a capacitor connected between said cathode and said grid for reducing high tension supply ripple voltage.

3. An amplifier system as set forth in claim 1 including an input resonant cavity coupled to said tube input.

4. An amplifier system as set forth in claim 3 wherein said interelectrode capacitance includes input cavity cathode capacitance as measured from said cathode to said anode.

5. An amplifier system as set forth in claim 4 including a capacitor coupled between said cathode and said grid to reduce high tension supply ripple voltage.

6. An amplifier system as set forth in claim 3 wherein said interelectrode capacitance it is an input cavity grid capacitance as measured from said grid to said anode.

7. An amplifier system as set forth in claim 6 including a capacitor coupled between said cathode and said grid for reducing ripple voltage.

8. An amplifier system as set forth in claim 3 wherein said interelectrode capacitance is the tube cathode capacitance as measured from said cathode to said anode.

9. An amplifier system as set forth in claim 8 including a capacitor interposed between said cathode and said grid for reducing ripple voltage.

10. An amplifier system as set forth in claim 3 wherein said interelectrode capacitance is the tube grid capacitance as measured from said grid to said anode.

11. An amplifier system as set forth in claim 10 including a capacitor interposed between said cathode and said grid for reducing voltage ripple.

12. An amplifier system as set forth in claim 3 wherein said interelectrode capacitance includes the input cavity cathode capacitance as measured from said cathode to said anode and the input cavity grid capacitance as measured from said grid to said anode.

13. An amplifier system as set forth in claim 12 including a capacitor coupled between said cathode and said grid for reducing voltage ripple.

14. An amplifier system as set forth in claim 3 wherein said interelectrode capacitance includes the tube cathode capacitance as measured from said cathode to said anode and the tube grid capacitance as measured from said grid to said anode.

15. An amplifier system as set forth in claim 14 including a capacitor interposed between cathode and said grid for reducing voltage ripple.

* * * * *